US011585312B1

(12) United States Patent
Luo et al.

(10) Patent No.: US 11,585,312 B1
(45) Date of Patent: Feb. 21, 2023

(54) FOCUSED MICROWAVE OR RADIO FREQUENCY IGNITION AND PLASMA GENERATION

(71) Applicant: Southwest Research Institute, San Antonio, TX (US)

(72) Inventors: Yilun Luo, Ann Arbor, MI (US); Brad D. Moore, Boerne, TX (US); Christopher Suhocki, Battle Creek, MI (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 17/473,848

(22) Filed: Sep. 13, 2021

(51) Int. Cl.

| | |
|---|---|
| ***F02P 23/04*** | (2006.01) |
| ***H05H 1/52*** | (2006.01) |
| ***H05H 1/46*** | (2006.01) |
| ***H01T 13/44*** | (2006.01) |

(52) U.S. Cl.
CPC ..... *F02P 23/045* (2013.01); *H01T 13/44* (2013.01); *H05H 1/463* (2021.05); *H05H 1/52* (2013.01)

(58) Field of Classification Search
CPC ..... F02P 23/045; H01T 13/44; H05H 1/463; H05H 1/52
See application file for complete search history.

(56) References Cited

U.S. PATENT DOCUMENTS 4,556,020 A * 12/1985 Hickling ..... F02B 51/06 123/143 B
4,726,336 A * 2/1988 Hoppie ..... F02P 23/04 123/558
5,027,764 A * 7/1991 Reimann ..... F02M 27/08 123/143 B
5,361,737 A * 11/1994 Smith ..... F02P 9/007 123/143 B
5,367,869 A * 11/1994 DeFreitas ..... F23D 11/36 60/776
5,404,712 A * 4/1995 Few ..... F23Q 13/00 60/39.821
5,515,681 A * 5/1996 DeFreitas ..... F23D 11/42 60/39.821
5,829,419 A * 11/1998 Sadkin ..... F02M 27/06 123/538
5,845,480 A * 12/1998 DeFreitas ..... F02P 23/04 60/776
5,983,871 A * 11/1999 Gordon ..... F02P 23/04 123/143 B
6,581,581 B1 * 6/2003 Bebich ..... F02P 23/045 123/536
7,036,492 B2 * 5/2006 Yoshimoto ..... F02B 51/06 123/538

(Continued)

*Primary Examiner* — Joseph J Dallo
(74) *Attorney, Agent, or Firm* — Livingston Law Firm

(57) ABSTRACT

A method of providing spark ignition for an engine or other equipment having a combustion chamber. A radio frequency wave or a microwave (RF/microwave) generator delivers radio frequency waves or microwaves to a transmit antenna inside the combustion chamber. At least one RF/microwave receive antenna is attached to an internal surface of the combustion chamber and comprises two or more RF/microwave focusing features with a spark gap between them. The transmit antenna wirelessly energizes the receive antenna, which generates a spark between the two focusing features.

16 Claims, 7 Drawing Sheets

(56) References Cited

U.S. PATENT DOCUMENTS

| | | | | |
|---|---|---|---|---|
| 7,195,005 | B2 * | 3/2007 | Yoshimoto | F02P 23/04 123/538 |
| 7,404,395 | B2 * | 7/2008 | Yoshimoto | F02P 23/04 123/538 |
| 7,981,389 | B2 * | 7/2011 | Fanson | C10G 15/08 423/247 |
| 9,538,631 | B2 * | 1/2017 | Ikeda | H01Q 1/3291 |
| 9,796,002 | B2 * | 10/2017 | Lu | B08B 7/026 |
| 10,030,578 | B2 * | 7/2018 | Gallatz | F02B 55/14 |
| 10,036,364 | B2 * | 7/2018 | Ikeda | F02P 23/045 |
| 10,677,456 | B2 * | 6/2020 | Luo | H01Q 1/3208 |
| 2003/0041844 | A1 * | 3/2003 | Yoshimoto | F02B 51/06 123/543 |
| 2014/0261271 | A1 * | 9/2014 | Ikeda | H01T 13/50 315/111.41 |

* cited by examiner

FOCUSED MICROWAVE OR RADIO FREQUENCY IGNITION AND PLASMA GENERATION

TECHNICAL FIELD OF THE INVENTION

This patent application relates to internal combustion engines and other devices that use spark ignition, and more particularly to ignition systems for such engines and devices.

BACKGROUND OF THE INVENTION

Internal combustion engines require ignition of an air-fuel mixture, either by spark ignition (SI) or compression ignition (CI). Ignition subsystems for internal combustion engine vehicles are highly refined computer-controlled systems incorporating many significant technical advances.

Today's conventional spark-ignited engines use a spark plug to initiate a spark in the engine's combustion chamber, which ignites an air-fuel mixture in the chamber. Spark plugs are cylindrical devices that are installed into the combustion chamber via mounting holes on the cylinder head. The cylinder head also has other moving parts and internal cooling and lubrication circuits, and so only one spark plug can be installed per cylinder with perhaps two for very large engines. Only the center area of the cylinder head is suitable for spark plug installation, which means that the flame kernel must be at the top of the cylinder. Spark plug ignition systems suffer from problems with spark duration and energy, which limits dilution tolerance and combustion stability.

Alternative ignition methods have been explored, seeking improvements in thermal efficiency and emissions.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to a radio frequency or microwave (abbreviated as RF/microwave herein) ignition system that eliminates spark plugs in conventional internal combustion engines. By "RF/microwave" is meant either radio frequency waves or microwaves at a predetermined frequency or frequency range.

The system may also be used for other equipment having a combustion chamber, for jet engines, chemical reactors, and for any equipment or device that requires a wireless spark for ignition. The RF/microwave ignition system is suitable as an alternative to spark plug ignition systems as well as to provide a wireless spark in environments where a spark plug system is not suitable.

The RF/microwave ignition system not only generates a wireless spark but may also generate plasma during and/or after the spark event. Both are both beneficial to chemical reactions such as combustion.

As explained below, the RF/microwave ignition system uses focused radio frequency or microwave energy. Radio frequency waves or microwaves are delivered into the combustion chamber via a wired transmit antenna. A receive antenna is implemented as a pair of small features inside the combustion chamber that wirelessly receive radio frequency or microwave energy and focus the energy to a spark gap, thereby producing a spark and igniting the combustion fuel.

For ignition purposes, the RF/microwave generated spark ignition and combustion are simultaneous. This is in contrast to microwave enhanced combustion, which is used to enhance a flame ignited by a spark plug.

Figure 1:
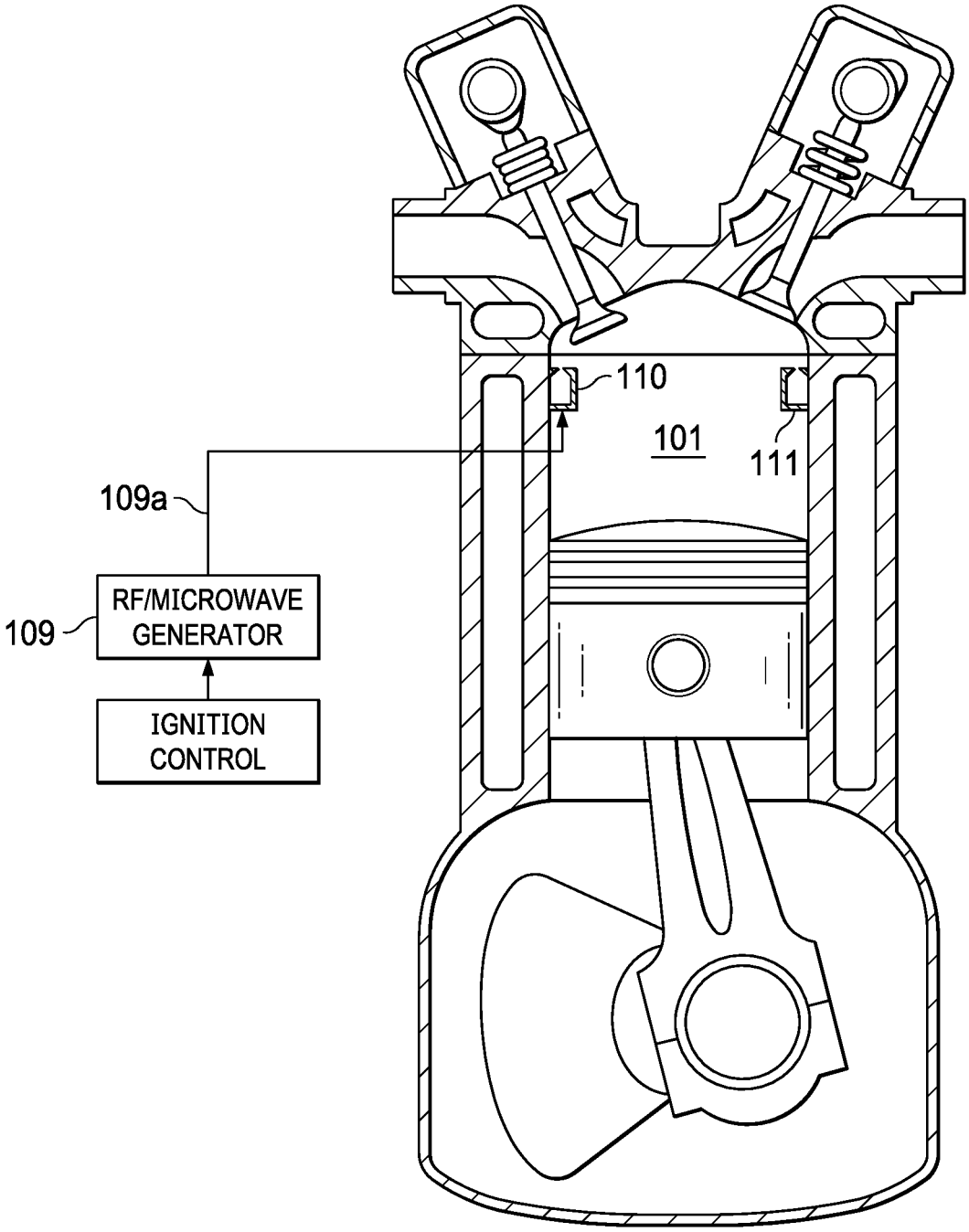
FIG. 1 is a cut away view of the inside of a typical cylinder of an internal combustion engine and of a microwave ignition system in accordance with the invention.

FIG. 1 is a cut away view of the inside of a typical cylinder 100 of an internal combustion engine. The engine may be any internal combustion engine for which a combustion product is ignited by a spark. This may include various engine platforms, such as gasoline, natural gas, and dual fuel.

The combustion chamber 101 is the volume between the piston 102 and the cylinder head. The example engine of FIG. 1 is an overhead cam engine, with an intake valve and exhaust valve having ports at the top of the cylinder. Of particular significance to this description is the compression of an air-fuel mixture, followed by ignition and combustion.

In accordance with the invention, combustion chamber 101 does not use a spark plug. Instead, ignition occurs as a result of an RF/microwave ignition system, which eliminates the need for a spark plug. RF/microwave energy produces a spark, which ignites a flame and is delivered directly to the flame front.

An RF/microwave generator 109, external to the combustion chamber 101, delivers radio frequency waves or microwaves at a predetermined power and frequency via a cable, waveguide, or other wired transmission line 109*a* to a transmit antenna 110 within the combustion chamber 101. Transmit antenna 110 may be implemented as any one of various antenna suitable for radio frequency or microwave transmission. One example is a dipole antenna.

A second antenna within the combustion chamber 101 is a receive antenna 111. A wireless RF/microwave energy transfer occurs between antennas 110 and 111 within the combustion chamber 101. As explained below, receiving antenna 111 is a spark ignitor and may also be a plasma generator after ignition.

An advantage of the invention is that transmitting antenna 110 and receiving antenna 111 may be located anywhere inside the combustion chamber 101; they need not be under the cylinder head. The antennas 110 and 111 may be located on the combustion chamber walls or they may be located anywhere that has fluid communication with the combustion chamber, including in the intake port, cylinder head, cylinder wall, piston head, or exhaust port. For purposes of this description, these various openings in fluid communication with the combustion chamber are deemed to be "in the combustion chamber".

Figure 2:
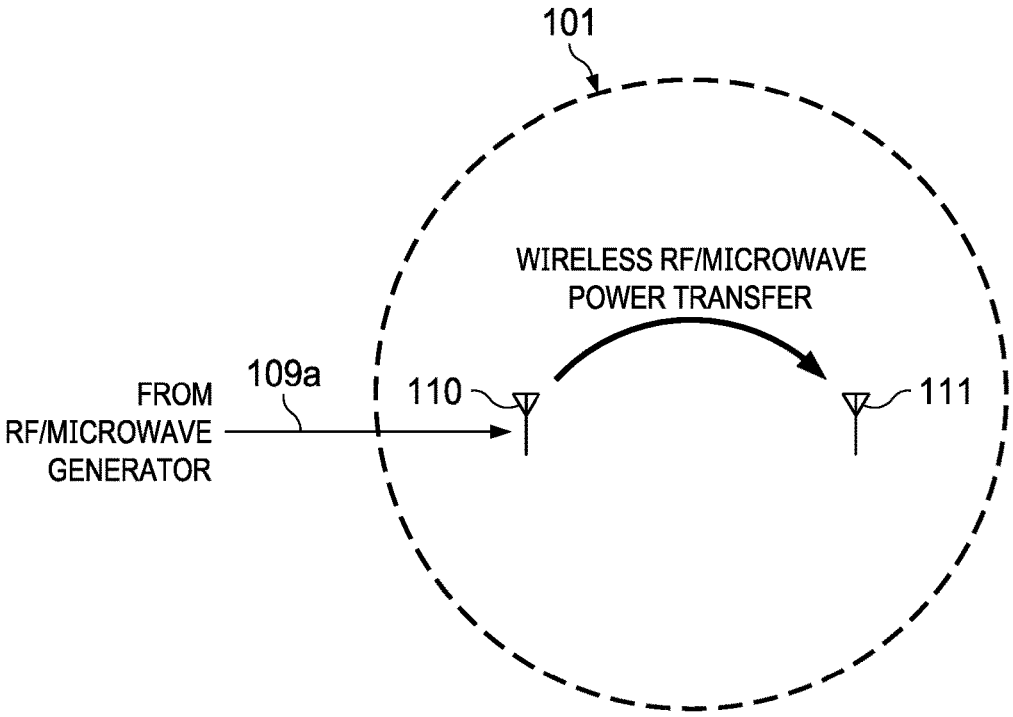
FIG. 2 schematically illustrates the operation of the antennas of FIG. 1 within the combustion chamber.

FIG. 2 schematically illustrates the generation of focused RF/microwaves within the combustion chamber 101 to create a spark. The transmit antenna 110 wirelessly delivers RF/microwave energy to the receive antenna 111. As explained below, the receiving antenna 111 is implemented as a pair of "focusing features", which receive and focus RF/microwaves across a gap to produce a spark.

Figure 3:
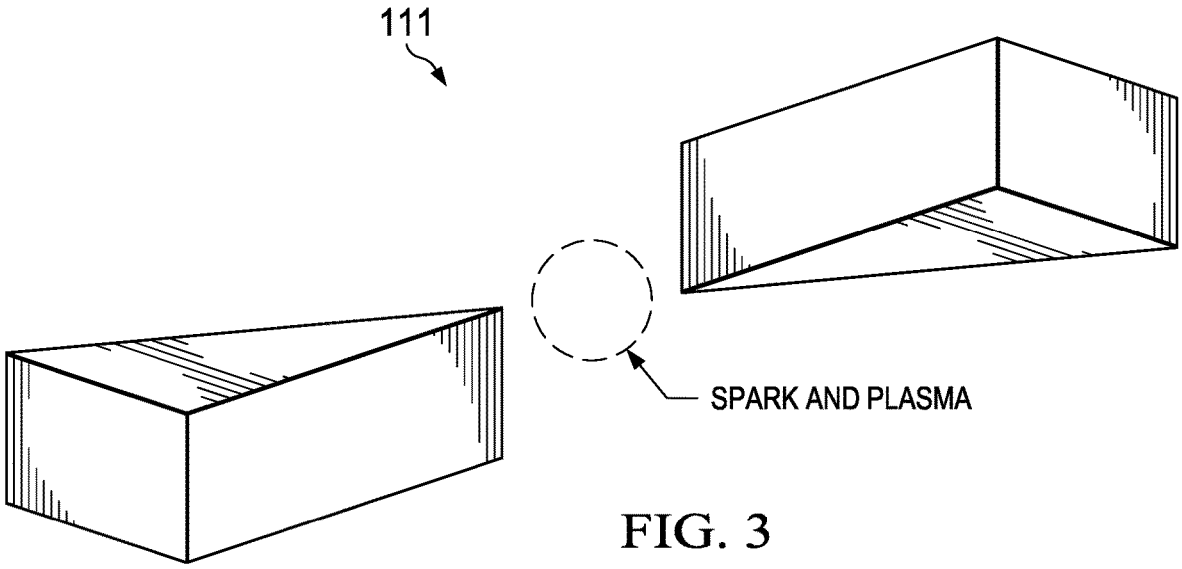
FIG. 3 schematically illustrates how the receiving antenna may be implemented as a pair of "focusing features".

FIG. 3 illustrates how the receiving antenna 111 is implemented as a pair of "focusing features" with a gap between them. Each focusing feature extends from the combustion chamber wall into the combustion chamber. These features may take various geometries, such as described in the examples below. Examples are features in the shape of sharp edges, ditches, bumps, wires, two-halves, pyramids, cones, tappers, balls, or any combination.

Figure 4:
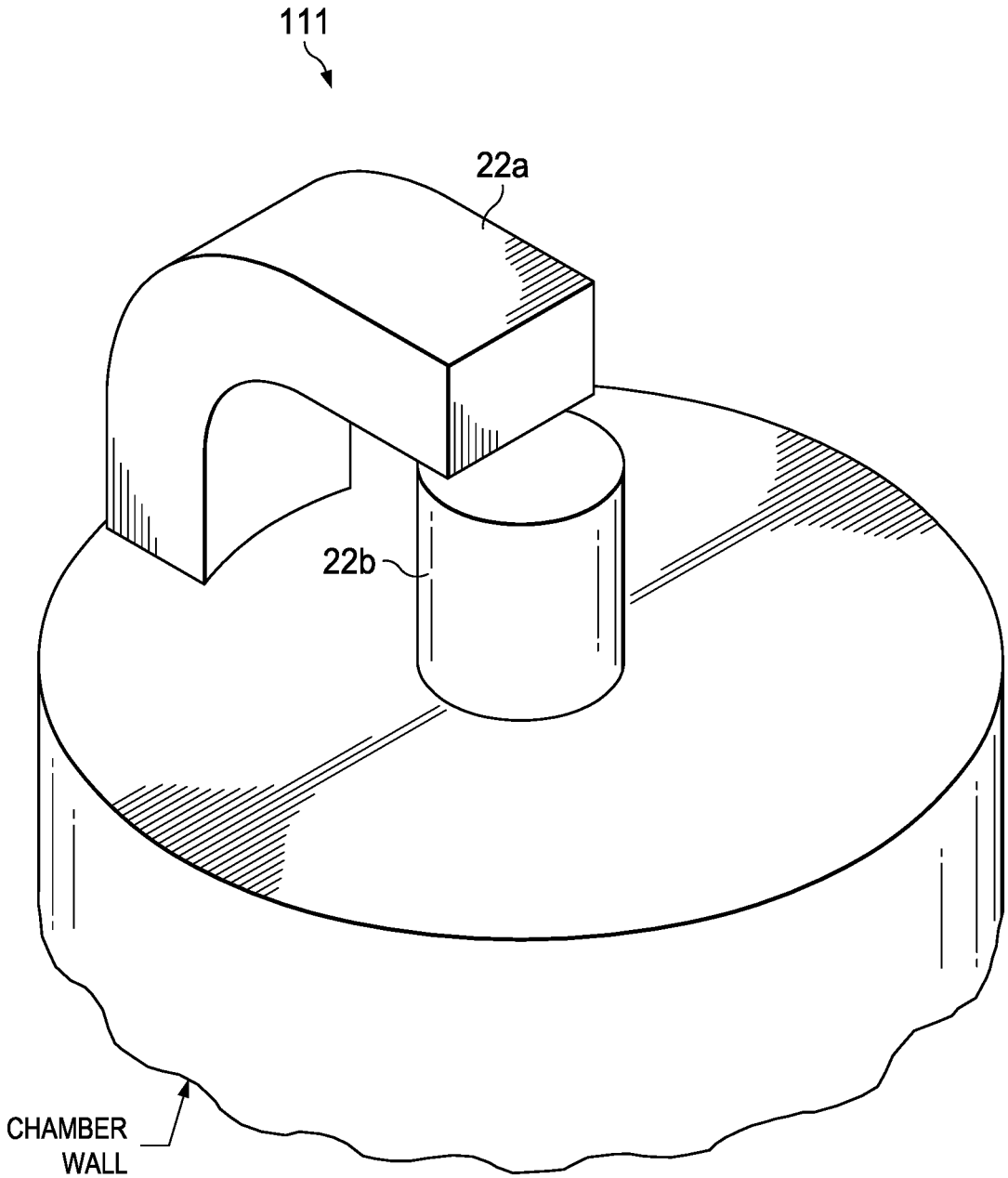
FIGS. 4-8 illustrate various embodiments of the receiving antenna.

FIG. 4 illustrates one embodiment of receiving antenna 111, comprising a pair of focusing features 22*a* and 22*b*. Each feature is attached to or integrated onto the inner surface of the combustion chamber 101.

In the embodiment of FIG. 4, one focusing feature 22*a* has the shape of a curved arm, raised above the inner surface of the combustion chamber 101, with a point of attachment to the inner surface. Feature 22*a* has a distal end (relative to the point of attachment), which is the focus point for spark generation. Although not shown in FIG. 4, feature 22*a* may have a defined focusing point on its distal end. Feature 22*b* is a raised feature formed on the inner surface of the combustion chamber 101. It is arranged so that there is a small gap between its distal end (relative to the chamber wall) and the distal end of feature 22*a*. This gap is where the RF/microwave energy is focused to create a spark for ignition.

Figure 5:
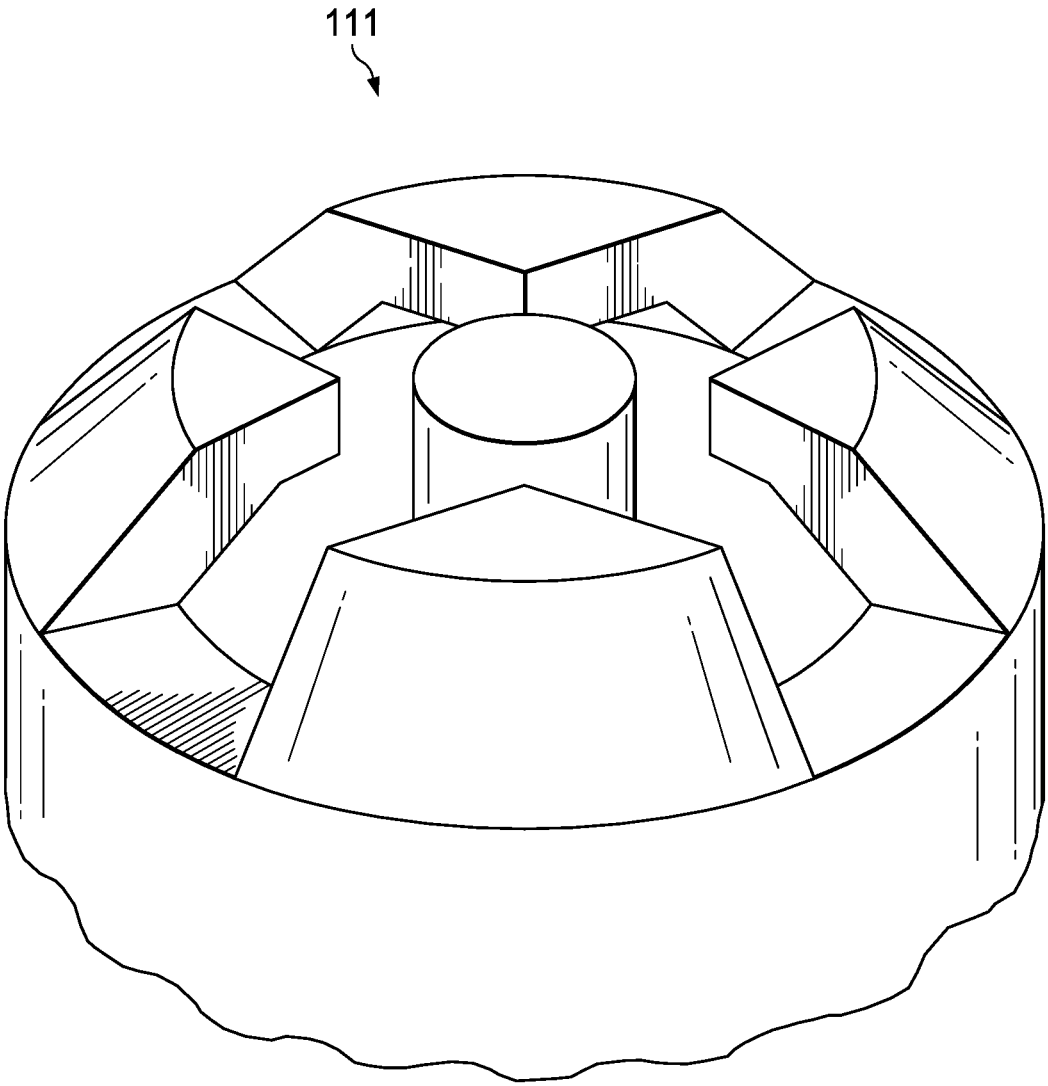
Figure 6:
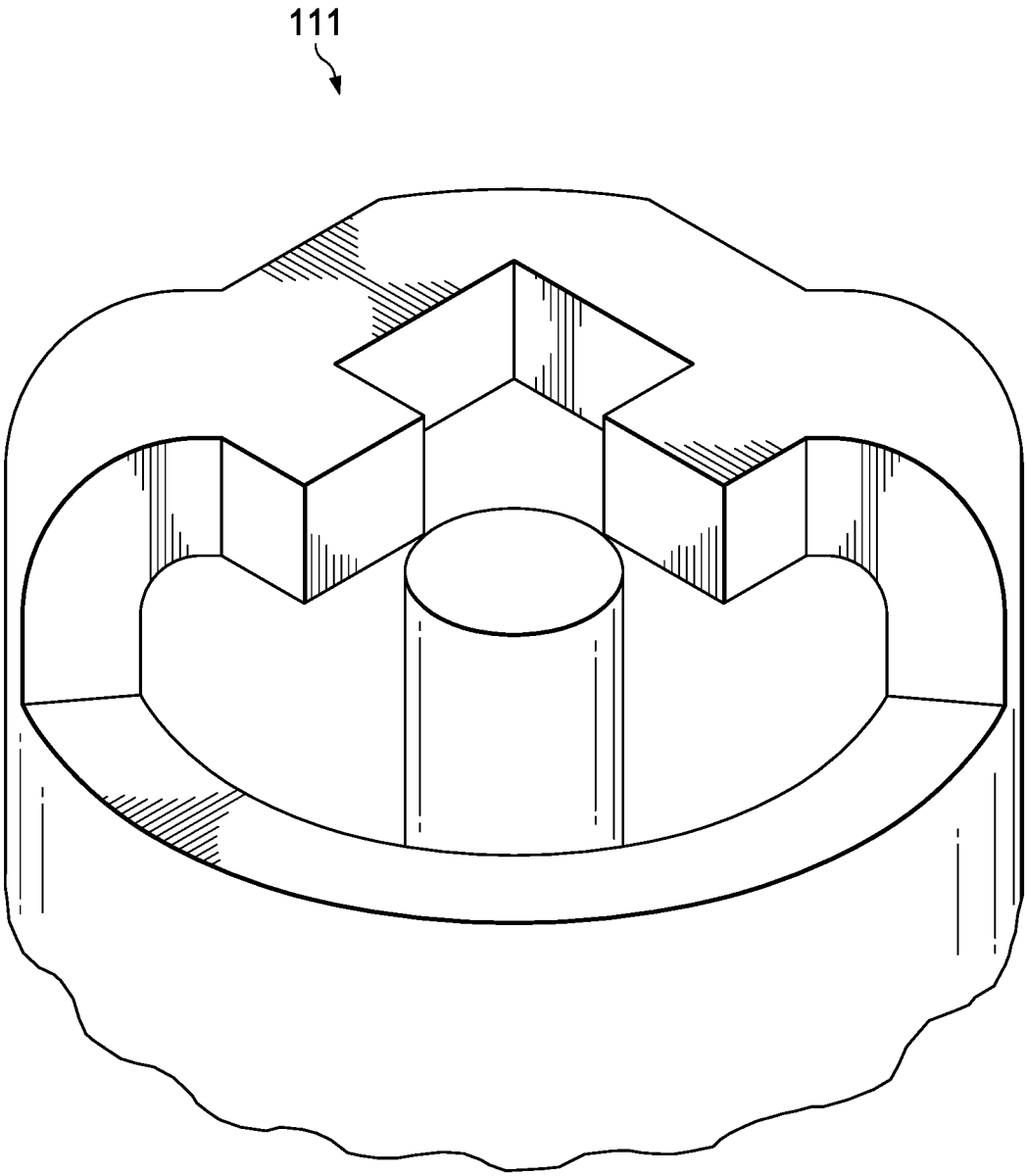

FIGS. 5 and 6 illustrate alternative embodiments of the receiving antenna 111. In both FIGS. 5 and 6, instead of a pair of focusing features, there are multiple perimeter focusing features arranged in a circular pattern around a center focusing feature. There is a spark gap between each perimeter focusing feature and the center focusing feature.

In general, receiving antenna 111 is at least one pair of focusing features, raised from the inner surface of the combustion chamber. Each feature has a focusing point, spaced from a focusing point of the other feature.

In operation, RF/microwaves generated by RF/microwave generator 109 are delivered to transmit antenna 110 using cable 109*a* or other "wired" transmission. Standing waves of high-strength electrical fields are created within the combustion chamber. An example of a suitable microwave energy is energy produced at 2.45 GHz. The gap between the features of receive antenna 111 focusses energy to create a strong electric field to create a spark for ignition.

Figure 7:
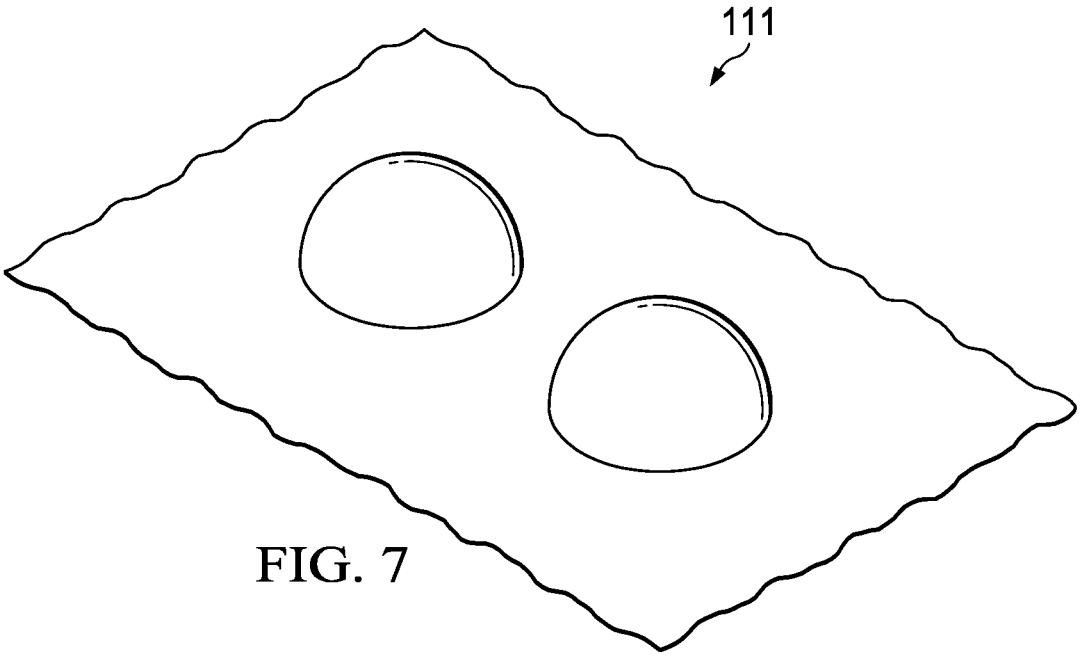

FIG. 7 illustrates an example in which the focusing features of receiving antenna 111 are implemented as raised hemispheres on the inner wall of the combustion chamber 101.

Figure 8:
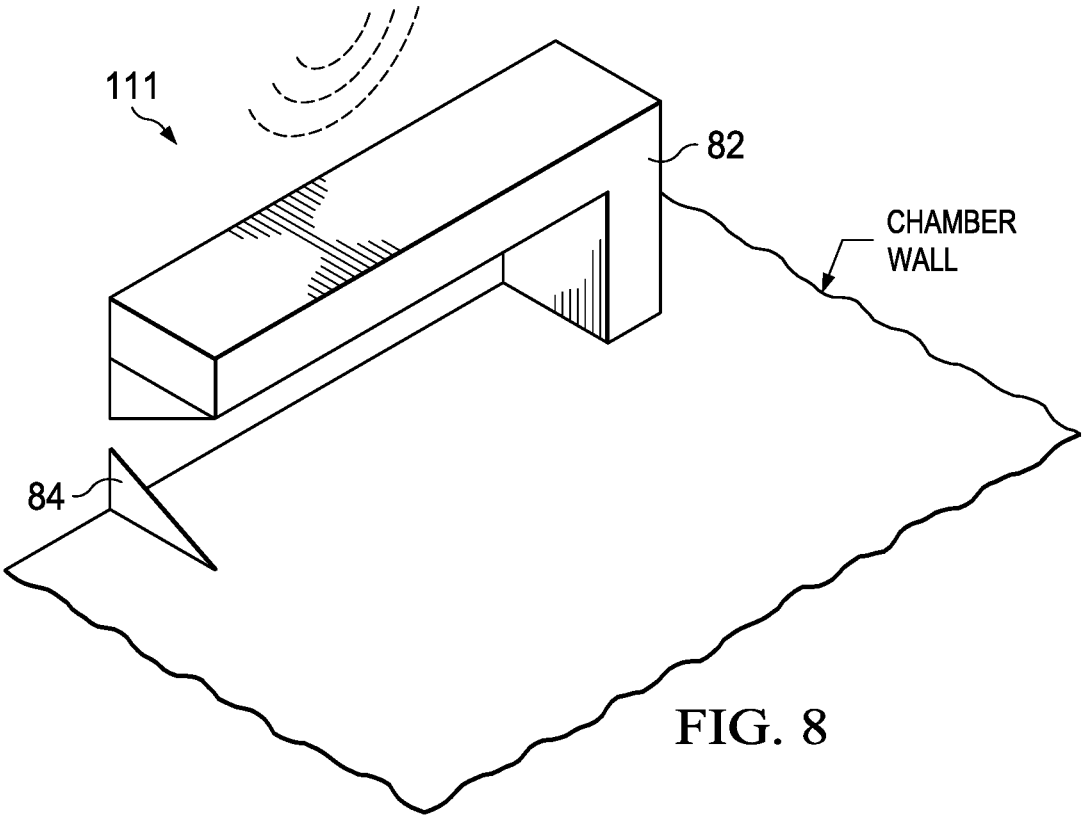

FIG. 8 illustrates a receiving antenna 111 having one feature implemented as an "arm" 82 having a triangular point 83 at its end. The other feature of receive antenna 111 is a pointed triangular feature 84.

In general, receive antenna 111 may comprise two or more features that function to receive radio frequency or microwave energy and to focus that energy to create a spark. The features extend from the inner surface of the combustion chamber to create a gap between at least two focusing points. This gap creates a radio frequency or microwave spark gap.

Antennas 110 and 111 are easily implemented by manufacturing them as integral parts of the combustion chamber. However, if desired, either or both of the antennas can be configured as a replaceable metal and dielectric part. In either case, an advantage of using antennas 110 and 111 for ignition that it saves design and component cost compared to the traditional spark plug. It provides ease of maintenance and fabrication. It simplifies cylinder head design and does not block in-cylinder flow compared to the traditional spark plug.

In other embodiments, combustion chamber 101 could be equipped with multiple receive antennas 111. A distributed spark would no longer need the Stark Effect to hurry along the burn front.

Figure 9:
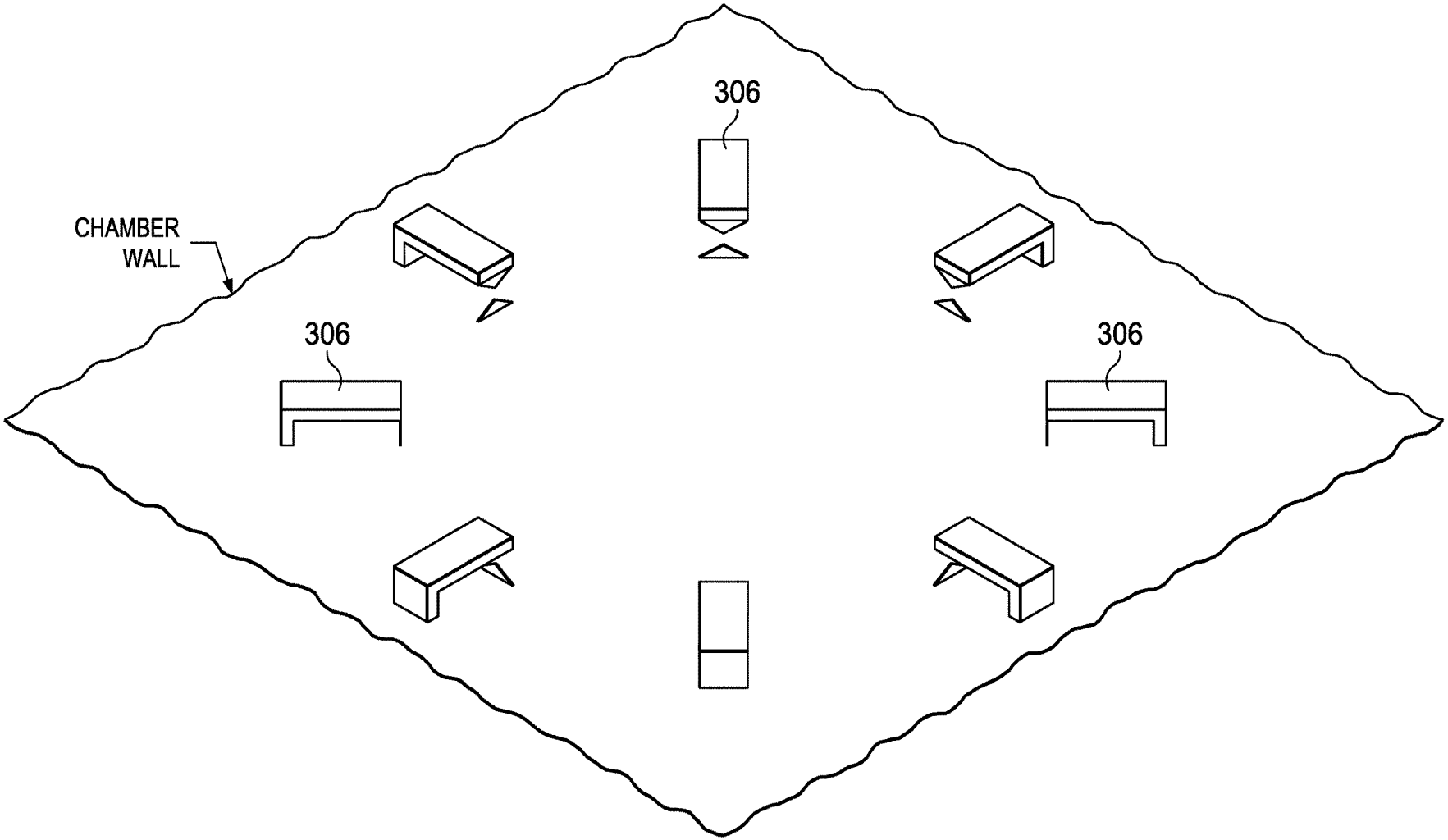
FIG. 9 illustrates an array of receiving antennas.

FIG. 9 illustrates multiple receive antennas 306, such as might be installed on a combustion chamber wall. In the example of FIG. 9, the antennas have the same configuration as in FIG. 8, but any of the various configurations described herein could be used to provide a spark gap between RF/microwave focusing points.

In the example of FIG. 9, the receive antennas 306 are arranged in a circular pattern. This type of array could be located at the top of a combustion chamber 101 or other suitable locations.

RF/microwave spark ignition with multiple ignitors can be individually controlled by phasing using a single antenna pair, or by an RF/microwave phase array using multiple antenna pairs.

The above-described RF/microwave ignition system enhances combustion by enhancing flame kernel development, chemical kinetics, and flame speed. The ignitor thereby enables higher dilution, faster burn, and cooler combustion. Thermal efficiency is improved and knock is mitigated.

If desired, RF/microwave spark ignition can be followed by RF/microwave enhanced combustion to generate radicals or heating to enhance combustion or emission reactions from chemical kinetics.

What is claimed is:

1. A method of providing spark ignition for an engine or other equipment having at least one cylinder with a combustion chamber in which a fuel is ignited and combusted without a spark plug, comprising:

locating an RF/microwave (radio frequency or microwave) transmit antenna inside the combustion chamber;

equipping an internal surface of the combustion chamber with at least one RF/microwave receive antenna;

wherein the at least one RE/microwave receive antenna comprises two or more RF/microwave focusing features, each feature being attached to an internal surface of the combustion chamber and arranged to provide a gap structure between the focusing features;

wherein the focusing features have edges or other discontinuities operable to receive and concentrate microwave energy and to create local voltage differentials when microwave energy is applied, thereby causing sparking between them;

generating radio frequency waves or microwaves with an RF/microwave generator external to the combustion chamber;

delivering the radio frequency waves or microwaves to the transmit antenna;

wherein the radio frequency waves or microwaves have a predetermined power and frequency to cause the sparking and to thereby ignite the fuel without use of a spark plug and/or ignition coil.

2. The method of claim 1, wherein the delivering step is performed with a cable or other wired transmission line or guide.

3. The method of claim 1, wherein at least one of the focusing features has an arm shape.

4. The method of claim 1, wherein at least one of the focusing features has a pointed shape.

5. The method of claim 1, wherein at least one of the focusing features has a hemispherical shape.

6. The method of claim 1, wherein a number of focusing features are arranged around a center focusing feature.

7. The method of claim 1, wherein the delivering step is performed for only spark generation.

8. The method of claim 1, wherein the delivering step is followed by plasma generation during and/or after ignition.

9. The method of claim 1, wherein the at least one RF/microwave receive antenna comprises a number of pairs of focusing features.

10. A radio frequency or microwave (RF/microwave) spark ignition system for an engine or other equipment having at least one cylinder with a combustion chamber in which a fuel is ignited and combusted without a spark plug, comprising:

an RF/microwave generator external to the cylinder;

an RF/microwave transmit antenna within the combustion chamber, configured to receive radio frequency waves or microwaves from the RE/microwave generator; and at least one RF/microwave receive antenna attached to an inner surface of the combustion chamber;

wherein the at least one RF/microwave receive antenna comprises two or more RF/microwave focusing features, each feature being attached to the inner surface of the combustion chamber and arranged to provide a spark gap between the focusing features;

wherein the focusing features have edges or other discontinuities operable to receive and concentrate microwave energy and to create local voltage differentials when microwave energy is applied, thereby causing sparking between them to provide ignition for the fuel.

11. The system of claim 10, wherein the transmit antenna receives the radio frequency waves or microwaves via a cable or other wired transmission line or guide.

12. The system of claim 10, wherein at least one of the focusing features has an arm shape.

13. The system of claim 10, wherein at least one of the focusing features has a pointed shape.

14. The system of claim 10, wherein at least one of the focusing features has a hemispherical shape.

15. The system of claim 10, wherein a number of focusing features are arranged around a center focusing feature.

16. The system of claim 10, wherein the at least one RF/microwave receive antenna comprises a number of pairs of focusing features.

* * * * *